US008297096B2

(12) United States Patent
Mizumura et al.

(10) Patent No.: US 8,297,096 B2
(45) Date of Patent: Oct. 30, 2012

(54) METHOD FOR HYDROFORMING AND HYDROFORMED PRODUCT

(75) Inventors: Masaaki Mizumura, Tokyo (JP); Koichi Sato, Tokyo (JP); Yukihisa Kuriyama, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 285 days.

(21) Appl. No.: 12/452,676

(22) PCT Filed: Jul. 18, 2008

(86) PCT No.: PCT/JP2008/063469

§ 371 (c)(1), (2), (4) Date: Jan. 13, 2010

(87) PCT Pub. No.: WO2009/014233

PCT Pub. Date: Jan. 29, 2009

(65) Prior Publication Data

US 2010/0186473 A1 Jul. 29, 2010

(30) Foreign Application Priority Data

Jul. 20, 2007 (JP) ..... 2007-189235

(51) Int. Cl.
*B21D 9/15* (2006.01)
*B21D 26/02* (2011.01)

(52) U.S. Cl. ..... 72/57; 72/58; 72/61; 72/62; 29/421.1

(58) Field of Classification Search ..... 72/57, 58, 72/61, 62

See application file for complete search history.

(56) References Cited

U.S. PATENT DOCUMENTS 5,070,717 A * 12/1991 Boyd et al. ..... 72/55
5,107,693 A * 4/1992 Olszewski et al. ..... 72/58
(Continued)

FOREIGN PATENT DOCUMENTS

EP 1 134 047 9/2001
(Continued)

OTHER PUBLICATIONS

Majima, S. et al., "Application of Tube Hydroforming to Automotive Parts," Journal of Society of Automotive Engineers of Japan, vol. 57, No. 6 (2003), pp. 23-28. [Abstract translated].

(Continued)

*Primary Examiner* — David B Jones
(74) *Attorney, Agent, or Firm* — Kenyon & Kenyon LLP

(57) ABSTRACT

The object is to raise the yield by greatly eliminating the disposed amounts of the tube ends, prevent wrinkles due to closing the mold while applying internal pressure, cutting the plurality of steps of hydroforming and pre-processing of the tube ends, cutting the mold costs by simplifying the mold mechanism, and obtaining a hydroformed product formed with a flange along its entire length.

For this reason, the present invention provides a hydroforming method which places a metal tube to a lower mold in the state with the tube ends sticking out from it and injects a pressurizing fluid into the metal tube through the inside of a seal punch and gradually presses seal punches against tube ends of the metal tube to apply a predetermined pressing force and fill the inside of the metal tube with the pressurizing fluid to apply a predetermined internal pressure, next, in the state with the internal pressure and pressing force applied, lowers the upper mold and closes the mold so as to deform the tube and end the processing in the state with the tube ends sticking out from the mold, and, further, boosting the internal pressure in the metal tube after closing the mold and ending the forming operation and a hydroformed product processed using these methods and having a flange across the entire length in the longitudinal direction.

5 Claims, 7 Drawing Sheets

U.S. PATENT DOCUMENTS

| | | | | |
|---|---|---|---|---|
| 5,481,892 | A * | 1/1996 | Roper et al. | 72/61 |
| 5,890,387 | A * | 4/1999 | Roper et al. | 72/58 |
| 5,987,950 | A * | 11/1999 | Horton | 72/58 |
| 6,006,567 | A * | 12/1999 | Brown et al. | 72/58 |
| 6,739,166 | B1 * | 5/2004 | Shah | 72/57 |
| 7,096,700 | B2 * | 8/2006 | Marando | 72/58 |
| 2008/0035628 | A1 | 2/2008 | Dudziak | |

FOREIGN PATENT DOCUMENTS

| | | |
|---|---|---|
| EP | 1 382 518 | 1/2004 |
| JP | 8-19820 | 1/1996 |
| JP | 09-150225 | 6/1997 |
| JP | 10-296347 | 11/1998 |
| JP | 2000-102825 | 4/2000 |
| JP | 2001-009529 | 1/2001 |
| JP | 2001-259754 | 9/2001 |
| JP | 2004-181477 | 7/2004 |
| JP | 2004-042077 | 12/2004 |
| JP | 2006-061944 | 3/2006 |
| WO | WO 2005/051562 | 6/2005 |

OTHER PUBLICATIONS

International Search Report dated Oct. 21, 2008 issued in corresponding PCT Application PCT/JP2008/063469.

Kalpakjian, Scrope et al.: "Manufacturing Processes for Engineering Materials," Industrial Material Engineering, Third Edition. Pearson Engineering Korea Ltd, Jan. 25, 2011, with and English translation of an excerpt thereof.

* cited by examiner

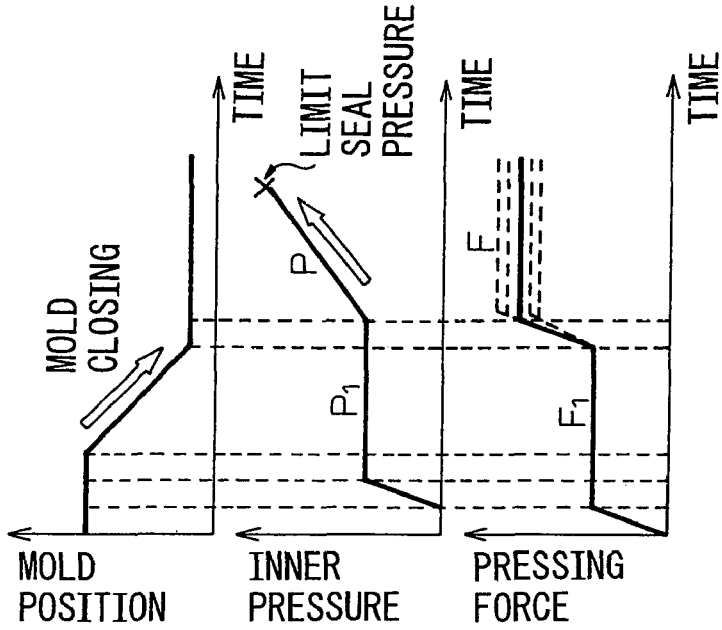
Fig.5
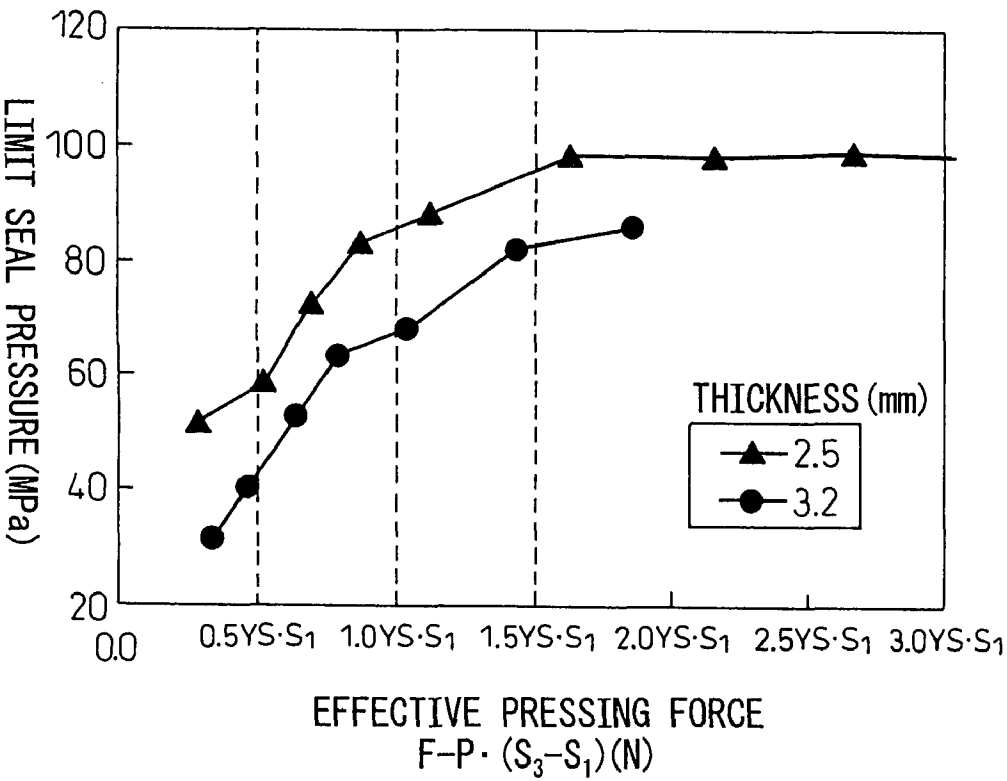

(a)

(b)

METHOD FOR HYDROFORMING AND HYDROFORMED PRODUCT

This application is a national stage application of International Application No. PCT/JP2008/063469, filed 18 Jul. 2008, which claims priority to Japanese Application No. 2007-189235, filed 20 Jul. 2007, which is incorporated by reference in its entirety.

TECHNICAL FIELD

The present invention relates to a hydroforming method comprising placing a metal tube in a mold, closing the mold, then applying internal pressure inside the tube to form it to a predetermined shape and a hydroformed product formed by this.

BACKGROUND ART

The general processing steps in conventional hydroforming will be explained below using FIG. 1.

First, a metal tube 1 shorter in length than the mold is placed inside a groove of the lower mold 2 so that the tube ends of the metal tube 1 are positioned inside from the end faces of the mold (same figure (a)).

The metal tube 1 of this example is an example of a straight tube. In the case of a bent tube, it is necessary to perform the bending in advance so as to become a shape matching the groove of the lower mold 2.

Next, the upper mold 3 is lowered to close the mold and clamp the metal tube 1 between the lower mold 2 and the upper mold 3 (same figure (b)).

After that, the seal punches 4 and 5 are made to advance. Water is inserted as a pressurizing fluid from the seal punch 4 having a water insertion port 6 while making the punches advance. Substantially simultaneously with the water 7 being filled inside the metal tube 1, the seal punches 4 and 5 are made to contact the end faces of the metal tube 1 to seal them to prevent the water 7 from leaking (same figure (c)).

After that, the pressure inside the metal tube 1 (below, referred to as the internal pressure) is raised to obtain the hydroformed product 8 (same figure (d)). To prevent the water 7 from leaking and secure a seal at this step, the cross-sectional shape of the tube ends 9 of the metal tube 1 and the tube end vicinities 9' may be made the same circular shapes as before being worked.

However, when the end faces of the final product 10 are not the same shapes as the tube material, since the tube ends 9 and tube end vicinities 9' and the transition parts 11 are unnecessary, they are cut off and discarded (same figure (e)). That is, the yield falls by that amount.

An example reducing this drop in yield is described in "Automobile Technology (vol. 57, no. 6 (2003), p. 23)". In this example, the tube ends are not circular, but are rectangular in cross-section the same as the end face shapes of the final product shape. However, in this case, before placing the metal tube to the mold, pre-forming for forming the tube ends into rectangular cross-sections becomes necessary.

In the method described in Japanese Patent Publication (A) No. 2004-42077, a metal tube with a circular cross-section is placed as it is to the lower mold so that the tube ends of the metal tube become inside the end faces of the mold. Along with the descent of the upper mold, the tube ends are made to deform to rectangular cross-sections. The rectangular cross-section seal punches are made to abut against these as is, then the pressurizing fluid is supplied to the inside of the metal tube for axial pressing as necessary. However, while this method can be applied to elliptical, rectangular, oblong, and other relatively simple cross-sections, the front ends of the seal punches must be formed to the same shapes as the ends of the shaped article. Application to complicated cross-sections is considered difficult.

Further, to prevent wrinkles forming at the time of closing the hydroforming mold, the practice has been to close the mold while applying internal pressure. With the method, it is necessary to seal the tube ends after finishing closing the mold, so for example as described in Japanese Patent Publication (A) No. 2001-9529, the method is adopted of closing the mold at just the tube ends and pushing the seal punches to secure a seal, then closing the mold at the tube center. Accordingly, the tube ends in this case are limited to a circular, elliptical, or other simple cross-sectional shapes.

On the other hand, hydroforming has the defect of the difficulty of spot welding and bolting with other parts after shaping. Therefore, technology for forming a flange at the time of hydroforming is proposed in Japanese Patent Publication (A) No. 2001-259754 or Japanese Patent Publication (A) No. 2006-61944. However, with these methods, pluralities of hydroforming steps or separate punches able to move in the mold become necessary. Further, with the method, it is believed difficult to form a flange along the entire length while applying internal pressure.

DISCLOSURE OF THE INVENTION

In the present invention, the object is to raise the yield of the hydroformed product by forming even the tube ends to the product shape as much as possible. Further, the inventors propose a hydroformed product having a flange along its entire length in the longitudinal direction formed by a single step.

To solve the problem, the present invention has as its gist the following:

(1) A hydroforming method characterized by placing a metal tube in a lower mold in a state with tube ends sticking out from the mold, injecting pressurized fluid into the metal tube through an inside of a seal punch while pressing seal punches against the tube ends of the metal tube to apply a predetermined pressing force, filling the inside of the metal tube with a pressurized fluid to apply a predetermined internal pressure, then, while applying the internal pressure and pressing force, lowering the upper mold and closing the mold, deforming the tube along with the tube end and finishing the forming operation in the state with the tube ends sticking out from the mold.

(2) A hydroforming method as set forth in (1), characterized by, after closing the mold, further boosting the internal pressure in said metal tube and ending the forming operation.

(3) A hydroforming method as set forth in either (1) or (2), characterized in that when a sectional area of a metal part of said metal tube in a cross-section vertical to an axial direction of said metal tube is $S_1$ [mm$^2$], a sectional area of an inside of said metal tube is $S_2$ [mm$^2$], an yield stress of said metal tube is YS [MPa], and said predetermined internal pressure is $P_1$ [MPa], a force $F_1$ [N] pressed by said seal punches when closing the mold satisfies formula (1):

$$P_1 \cdot S_2 + 0.3YS \cdot S_1 \leqq F_1 \leqq P_1 \cdot S_2 + 0.7YS \cdot S_1 \quad (1)$$

(4) A hydroforming method as set forth in (3), characterized in that when a sectional area of a metal part of said metal tube in a cross-section vertical to an axial direction of said metal tube is $S_1$ [mm$^2$], a sectional area of a cavity of said mold is $S_3$ [mm$^2$], an yield stress of said metal tube is YS [MPa], and an internal pressure boosted to after closing the mold is P [MPa], a force F [N] pressed by said seal punches when boosting the internal pressure after closing the mold satisfies formula (2):

$$P\cdot(S_3-S_1)+0.5YS\cdot S_1 \leqq F \leqq P\cdot(S_3-S_1)+1.5YS\cdot S_1 \quad (2)$$

(5) A hydroforming method as set forth in any one of (1) to (4), characterized in that when the length by which the tube ends of the metal tube stick out from the mold in the state before the seal punches press against the tube ends of the metal tube is made the seal length, the seal length is 2 to 4 times the plate thickness of the metal tube.

(6) A hydroforming method as set forth in any one of (1) to (5), characterized in that a Rockwell hardness of a surface of the seal punches contacting tube ends of the metal tube is HRC50 or more and a surface roughness is Ra2.0 or less.

(7) A hydroformed product characterized by comprising an integral deformed product obtained by a single step of hydroforming by a method as set forth in any one of (1) to (6), the hydroformed product characterized by having a flange along the entire length in the longitudinal direction.

(8) A hydroformed product as set forth in (7) having a curvature factor in the longitudinal direction.

Figure 1:
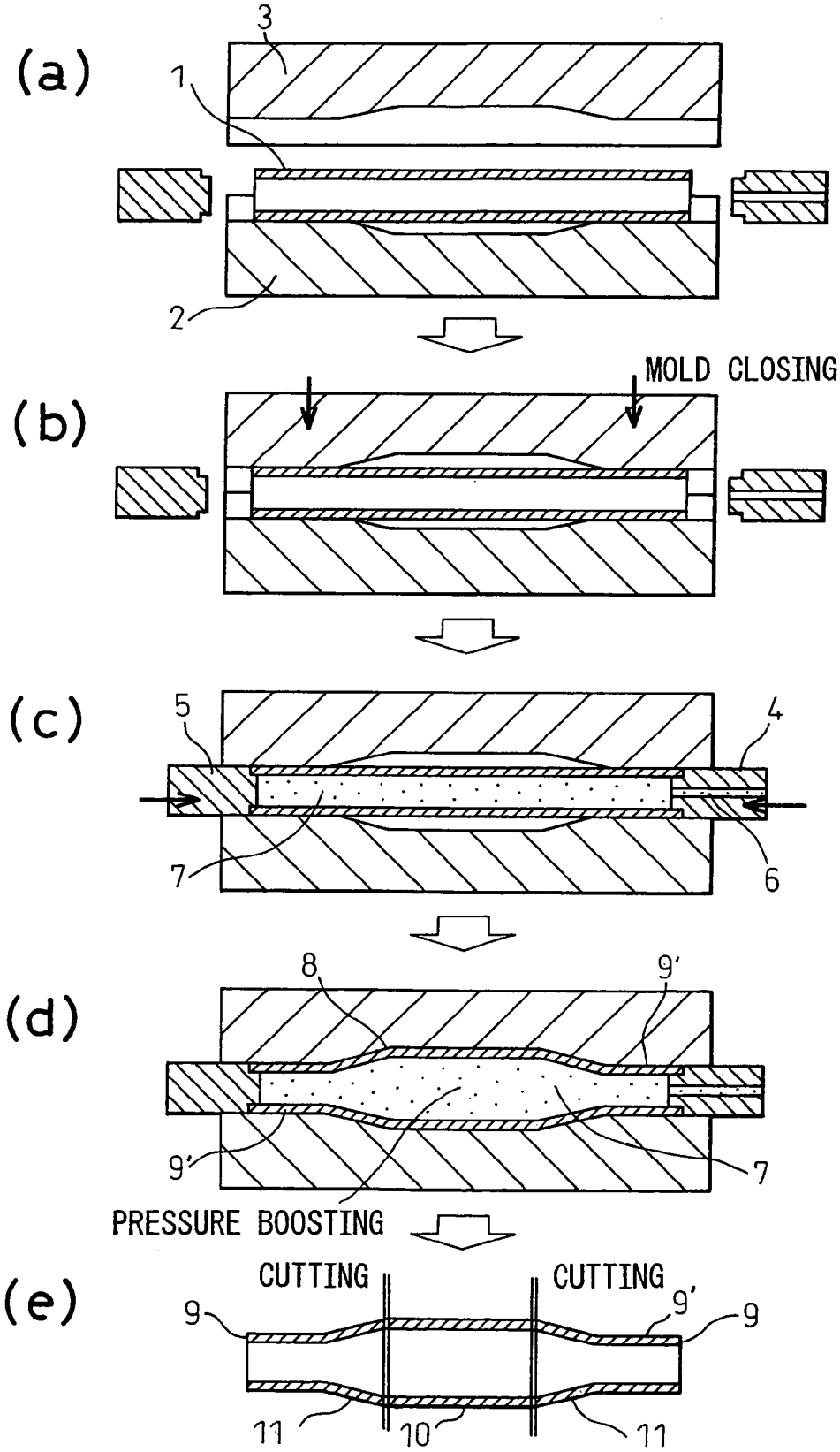
FIG. 1 gives explanatory views of a conventional general hydroforming step.

(a) state of placing metal tube 1 into groove of lower mold 2

(b) state of lowering upper mold 3 to close mold (closing mold)

(c) state of sealing tube ends 9 of metal tube 1 by seal punches 4 and 5

Figure 2:
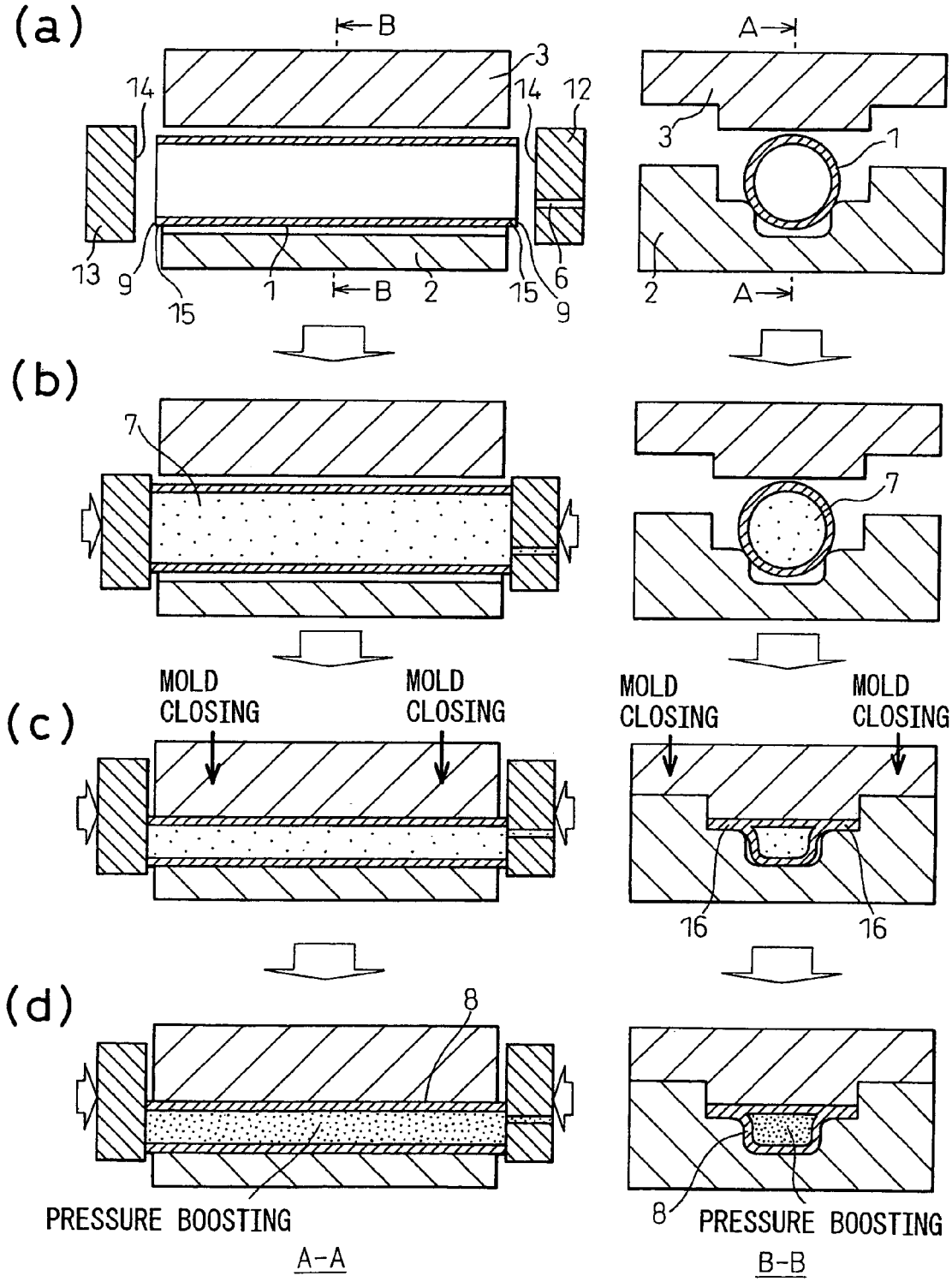

(d) state of raising internal pressure to end forming operation (e) final product cutoff from the formed tube FIG. 2 gives explanatory views of a hydroforming step of the present invention.

(a) state of placing metal tube 1 into groove of lower mold 2

Figure 3:
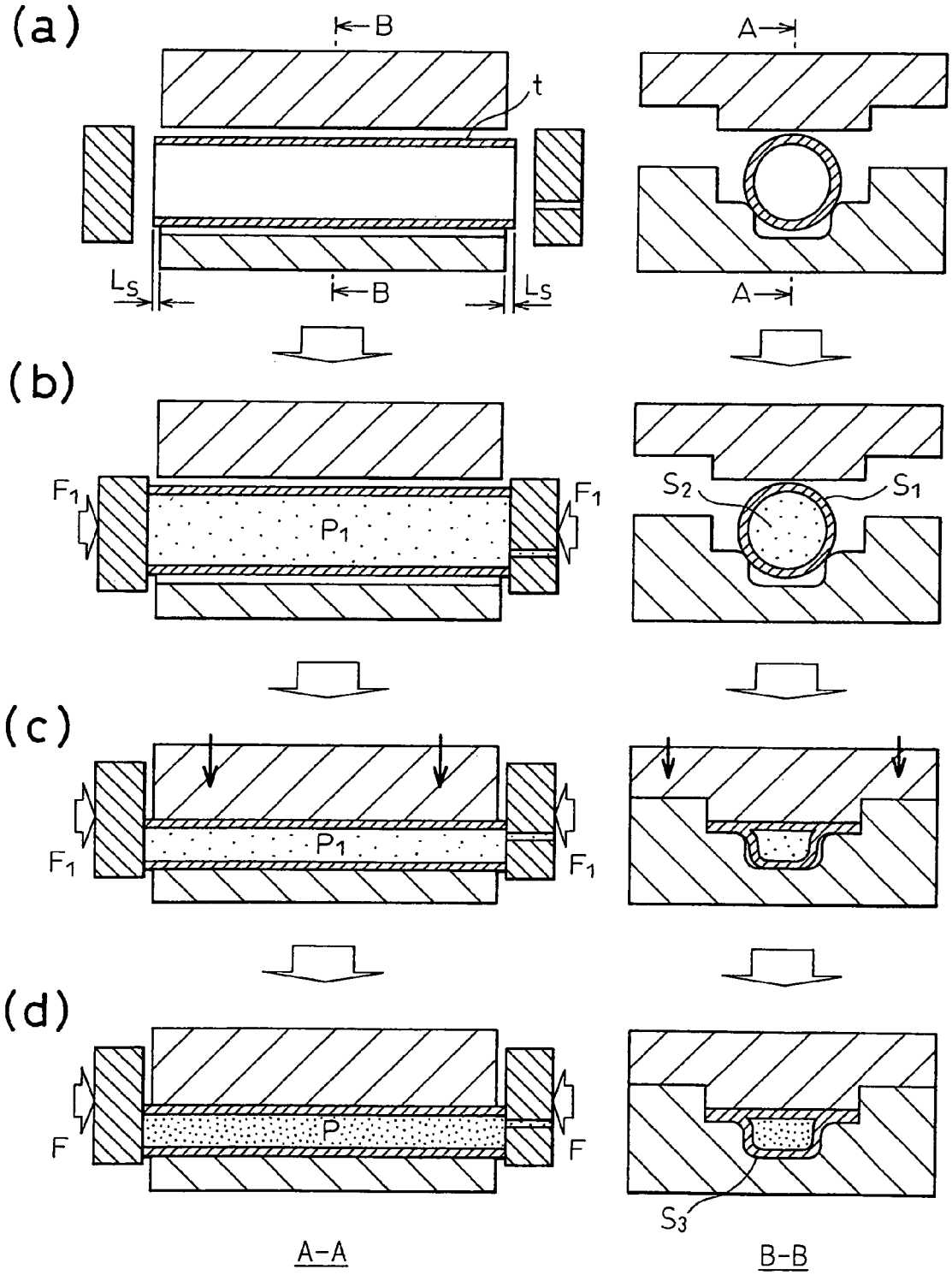

(b) state of using seal punches 12 and 13 to seal tube ends 9 of metal tube 1 and applying internal pressure (c) state of pressing seal punches 12 and 13 against tube ends 9 to apply internal pressure and in that state lowering the upper mold 3 to close the mold (d) state of raising the internal pressure after closing the mold so-as to end the forming operation FIG. 3 gives explanatory views of a hydroforming step of the present invention.

(a) state of placing metal tube 1 into groove of lower mold 2

Figure 4:
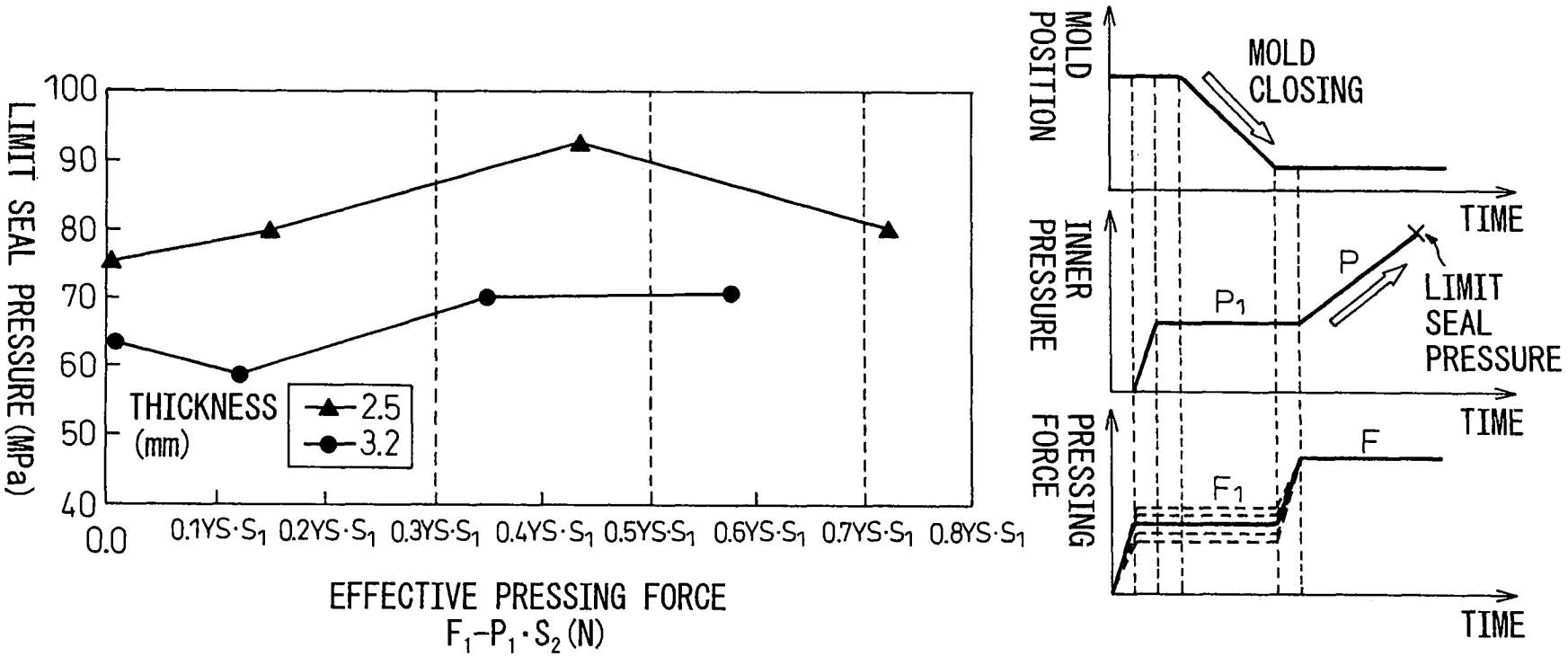

(b) state of using seal punches 12 and 13 to seal, tube ends 9 of metal tube 1 and applying internal pressure (c) state of pressing seal punches 12 and 13 against tube ends 9 to apply internal pressure and in that state lowering the upper mold 3 to close the mold (d) state of raising the internal pressure after closing the mold so as to end the forming operation FIG. 4 shows experimental results obtained by investigating the effects of the pressing force during mold clamping on the limit seal pressure.

FIG. 5 shows experimental results obtained by investigating the effects of the pressing force during increase of pressure on the limit seal pressure.

Figure 6:
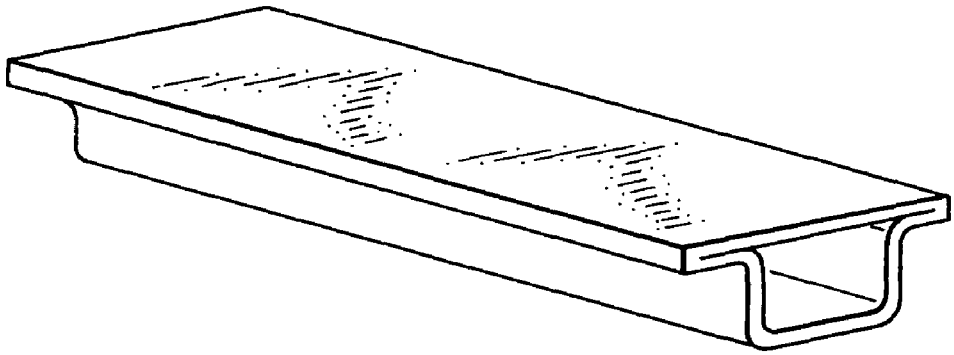
Figure 6:
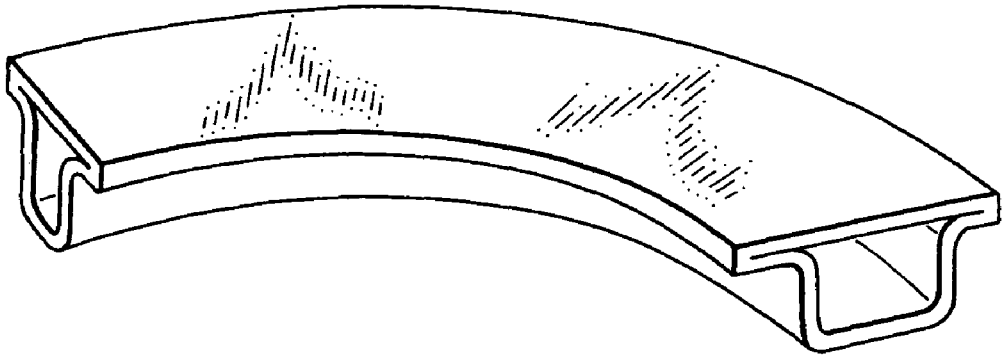

FIG. 6 gives explanatory views of a hydroformed product 8 having a flange along the entire length obtained according to the present invention.

Figure 7:
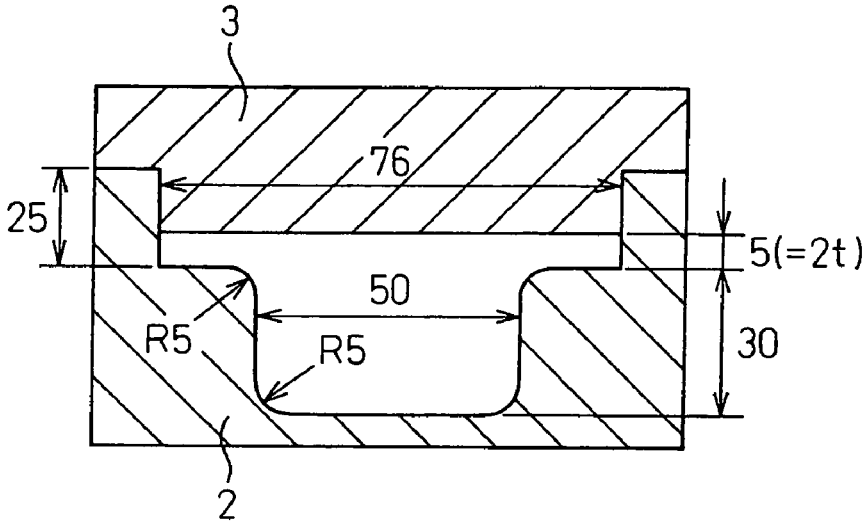

(a) a hydroformed product having a straight flange along its entire length (b) a hydroformed product having a flange having curvature in its longitudinal direction FIG. 7 is a cross-sectional view of a hydroforming mold used in the examples.

Figure 8:
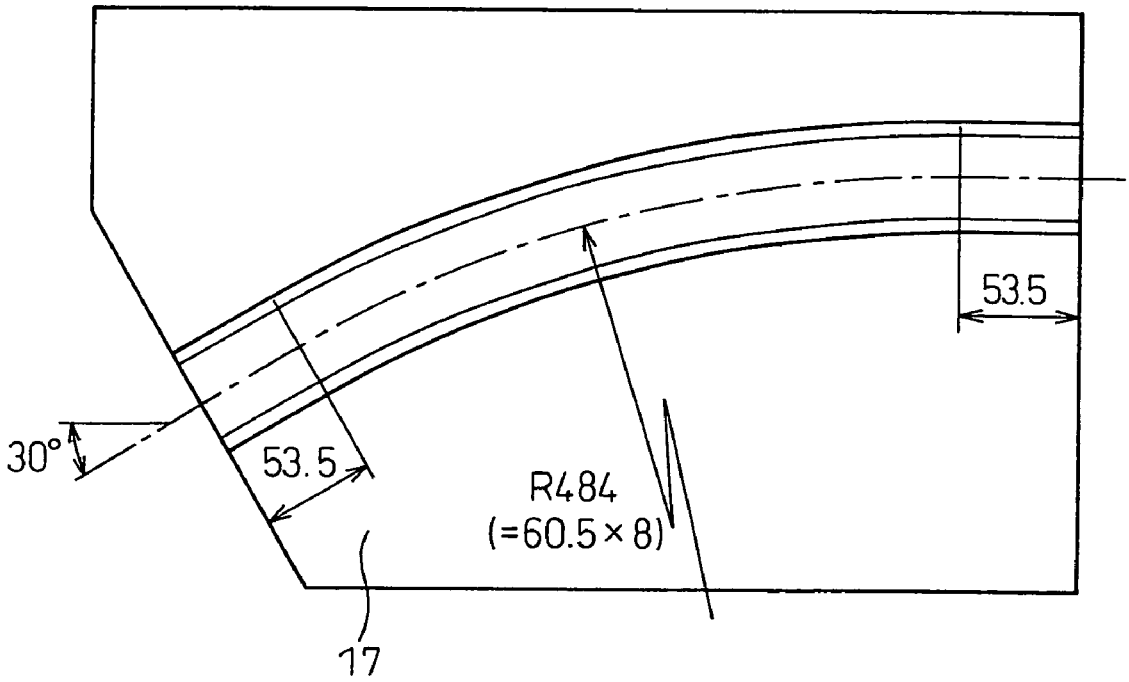

FIG. 8 is an explanatory view of a hydroforming lower mold used in an example in the case of a bent shape.

BEST MODE FOR WORKING THE INVENTION

FIG. 2 gives an example of forming a part shape having two flanges along the entire length by the method of the present invention. Below, this figure will be used for the explanation.

First, as shown in the same figure (a), the metal tube 1 is placed on the lower mold 2. At that time, the length of the metal tube 1 is made larger than the length of the lower mold 2, so the tube is placed in a state with the tube ends 9 sticking out slightly from the ends of the mold.

Here, flat type seal punches 12 and 13 will be explained. These punches differ in shape from the general hydroforming seal punches 4 and 5 such as in the above-mentioned FIG. 1. The seal fates 14 abutting against the tube ends form flat surfaces greater in area than the tube ends. The seal punch 4 is provided with an insertion port 6 for the water used as the pressurizing fluid. The position has to be set so as to be inside the metal tube 1 even in the state of the later explained FIGS. 2(*b*), (*c*), and (*d*).

The above seal punches 12 and 13 are made to gradually advance while filling water 7 inside the metal tube 1 through the water insertion port 6 so as press against and seal the tube ends 9 of the metal tube 1 as shown in FIG. 2(*b*) and applying predetermined pressing force. Further, the inside of the metal tube 1 is filled with water 7 serving as the pressurizing fluid to apply a predetermined internal pressure.

Next, as shown in FIG. 2(*c*), in the state with the seal punches 12 and 13 pressed against the tube ends 9 to apply internal pressure to the inside of the metal tube 1, the upper mold 3 is made to descend to close the mold.

In the process, the mold is closed while the cross-section in contact with the lower mold 2 and upper mold 3 of course and also the cross-section of the non-contacting sticking out parts 15 are deformed. Further, if closing the mold while maintaining the internal pressure, wrinkles etc, will not remain after closing the mold. If ending up closing the mold without internal pressure, the flat part at the top surface side of the cross-section B-B will not become flat, but will end up becoming a convex shape.

If forming the tube to the final part shape in the state of FIG. 2(*c*), the processing ends at the same figure (c) (above, the invention according to (1)), but when it is necessary to further expand the circumferential length, the internal pressure is boosted as is to end the processing. This being the case, as shown in the same figure (d), the part is finished to a shape along the inner surface of the mold whereby the final hydroformed product 8 is obtained (invention according to (2)).

Above, the hydroforming method according to the present invention was explained, but the desirable suitable conditions for reliably forming the seal will be explained below using FIG. 3.

First, the desirable pressing force for securing a seal will be explained.

The pressing force $F_1$ at the time of closing the mold (pressing force from (b) to (c) of FIG. 3) will be explained. The seal punches 12 and 13 are acted on not only by the reaction force at the time of pressing against the tube ends 9, but also the force due to the predetermined internal pressure P. The force due to the internal pressure $P_1$ is calculated by multiplying the sectional area of the tube inner surface with the internal pressure $P_1$. The sectional area of the tube inner surface gradually changes due to the deformation at the time of closing the mold. Accurately finding the value of the gradually changing sectional area is difficult, so considering safety first, the sectional area $S_2$ of the inside of the tube material at the cross-section vertical to the axial direction of the metal tube 1, considered to be the largest sectional area (tube in initial circular state before deformation), was employed. That is, the force due to the internal pressure $P_1$ is calculated as $P_1 \cdot S_2$. Accordingly, the effective force for sealing the tube ends becomes $F_1 - P_1 \cdot S_2$. To investigate the suitable value for this force, the inventors ran tests under various conditions to investigate the sealability.

As explained in the later explained Example 1, the inventors ran tests using a hydroforming mold while changing the force $F_1$ pressing against the seal punches when closing the mold. With each $F_1$, the internal pressure was raised while keeping the other working conditions the same (internal pressure $P_1$ during mold closure=10 MPa, pressing force F at time of boost of pressure=300 kN).

The internal pressure when the water 7 in the tube started leaking from the seal parts (limit seal pressure (MPa)) was measured. Note that for the tube material, in addition to a steel tube of a wall thickness of 2.5 mm used in Example 1, a steel tube of 3.2 mm was also used.

The results are shown in FIG. 4. According to the results, an effective force $F_1 - P_1 \cdot S_2$ for sealing the tube ends at the time of closing the mold of near $0.5YS \cdot S_1$, where the yield stress of the tube material is YS and the sectional area is $S_1$, results in the highest limit seal pressure. In a range smaller than $0.5YS \cdot S_1$, the end faces are hard to form into shapes suitable for sealing and leakage easily occurs by the subsequent boost in pressure. Conversely, in the range greater than $0.5YS \cdot S_1$, the shape becomes one where the end face buckles and leakage easily occurs by the subsequent increase in pressure. The suitable range of $F_1 - P_1 \cdot S_2$, from FIG. 4, is $0.3YS \cdot S_1$ to $0.7YS \cdot S_1$. Accordingly, the suitable range of $F_1$ can be expressed as follows:

$$P_1 \cdot S_2 + 0.3YS \cdot S_1 \leqq F_1 \leqq P_1 \cdot S_2 + 0.7YS \cdot S_1 \qquad \text{(invention of (3))}.$$

Next, the suitable pressing force F of the step (d) for boosting the pressure after that will be explained.

In this step as well, force due to internal pressure acts on the seal punches 12 and 13, so the pressing force F also has to be changed for a change of the internal pressure P. In the same way as the above-mentioned study, a force of a value of at least the internal pressure P multiplied with the sectional area of the inner surface of the tube becomes necessary. The sectional area of the inner surface of the tube of this step also gradually changes, but, again considering the safe side, envisioning the case where the sectional area is the largest, the area $S_3$ of the mold cavity of the final target shape in the cross-section vertical to the axial direction of the metal tube was employed. However, $S_3$, speaking in terms of a metal tube after finishing the forming operation, becomes the sum of the area of the inside of the tube and the sectional area of the tube itself in the cross-section vertical to the axial direction, so the area inside the tube becomes $S_3 - S_1$.

Accordingly, the effective force for sealing the tube ends 9 becomes $F - P \cdot (S_3 - S_1)$. The suitable value of this force was also investigated by the inventors.

The inventors ran tests using a hydroforming mold similar to the above and steel tubes (wall thicknesses of 2.5 mm and 3.2 mm) while changing in various ways the force F pressing against the ends while increasing the pressure. With each $F_1$, the internal pressure was raised while keeping the other working conditions the same (internal pressure $P_1$ during mold closure=10 MPa, pressing force $F_1$ during mold closure=75 kN). The pressure when the water in the tube leaked from the seal parts (limit seal pressure (MPa)) was measured.

The results are shown in FIG. 5. Note that the abscissa in the figure shows the force $F - P \cdot (S_3 - S_1)$ effective for sealing the tube ends while raising the pressure. The P at that time is calculated in the end by the value of the pressure at the time of leakage, that is, the limit seal pressure. From the results, the limit seal pressure increases along with the increase of the force $F - P \cdot (S_3 - S_1)$ effective for sealing the tube ends while increasing the pressure. Starting from $1.0\ YS \cdot S_1$, the pace becomes slower. Above $1.5YS \cdot S_1$, the pressure does not increase much at all and conversely falls as a general trend.

This is because the pressing force becomes too high, the end face buckles, and the seal easily leaks.

Accordingly, the upper limit of $F - P \cdot (S_3 - S_1)$ is made $1.5YS \cdot S_1$. On the other hand, regarding the lower limit, a pressure of at least about half of the maximum limit seal pressure at the respective steel tubes (with wall thickness of 2.5 mm, about 100 MPa, while with wall thickness of 3.2 mm, about 80 MPa) was made the sealable range and $0.5YS \cdot S_1$ was made the lower limit.

From the above, the suitable range of F can be expressed as follows:

$$P \cdot (S_3 - S_1) + 0.5YS \cdot S_1 \leqq F \leqq P \cdot (S_3 - S_1) + 1.5YS \cdot S_1 \qquad \text{(invention of (4))}.$$

Next, the length of the sticking out parts 15 of the tube ends of the metal tube from the ends of the mold when the metal tube is placed on the lower mold 2 (seal length $L_S$) will be explained. The inventors ran tests changing the seal length $L_S$ in various ways. As a result, they learned that if the seal length $L_S$ is too long, the pressing forces of the seal punches 12 and 13 cause the tube ends to buckle and sealing becomes impossible.

Further, the internal pressure causes the metal tube 1 to expand in the circumferential direction, so the axial direction shrinks somewhat. Accordingly, it is also learned that if the seal length $L_S$ becomes too short, the metal tube 1 will enter into the mold cavity and sealing will become impossible.

From the above, it was learned that the seal length $L_S$ shouldn't be too long or too short, specifically, a value of about three times the plate thickness t is suitable. Accordingly, the seal length $L_S$ is desirably set to a range of 2 to 4 times the plate thickness if considering the variations in materials or forming conditions (invention according to (5)).

Further, the seal surfaces 14 of the seal punches 12 and 13 should be as flat as possible to enable sliding while the tube ends are pressed against in the state of FIGS. 3(*c*) and (*d*). Specifically, they are preferably finished to a surface roughness of Ra 2.0 or less.

Further, to greatly reduce the wear at the time of mass production, the seal surfaces 14 should be high in strength. Specifically, a Rockwell hardness of HRC50 or more is preferable (invention according to (6)).

If hydroforming by the above procedure, an integral hydroformed product as formed by a single step of hydroforming having a flange part over its entire length as shown in FIG. 6(*a*) is obtained (invention according to (7)).

Further, if bending the tube in advance and placing it in a hydroforming mold having a cavity matching that bent shape for hydroforming by a similar procedure, as shown in the same figure (b), a hydroformed product having curvature along the entire length at the inside and outside of the bend is obtained (invention according to (8)).

In FIGS. 6(*a*) and (*b*), the example of a member having flange parts at the two sides was shown, but a member having a flange part along the entire length at only one side may also be formed by the present invention needless to say.

Below, examples of the present invention will be shown.

Example 1

For the tube material, a steel tube having an outside diameter of 60.5 mm, a wall thickness of 2.5 mm, and a total length of 370 mm was used. For the steel type, STKM13B of a steel tube made of carbon steel for machine structures was employed. The hydroforming mold had a cross-sectional shape across the entire length as shown in FIG. 7, a length of 360 mm, and a straight shape. Accordingly, the seal length $L_s$ in this case was 5 mm (=(370−360)/2) or two times the plate thickness of 2.5 mm. Further, the front ends of the seal punches were made 120×120 mm flat square shapes. For the material, SKD61 was employed. The surface hardness was made a Rockwell hardness of HRC54 to 57. The surface roughness of the front ends was made about Ra 1.6. The above tube materials and molds were used for hydroforming.

As the hydroforming conditions, the internal pressure $P_1$ at the time of closing the mold was made 10 MPa and the pressing force $F_1$ was made 100,000 N. Due to the size of the steel tube, the steel tube sectional area $S_1$ was 456 mm$^2$, the sectional area $S_2$ inside the tube was 2419 mm$^2$, and YS was 382 MPa. From the above, the following were calculated:

$$P_1 \cdot S_2 + 0.3YS \cdot S_1 = 10 \times 2419 + 0.3 \times 382 \times 456 = 76{,}448$$

$$P_1 \cdot S_2 + 0.7YS \cdot S_1 = 10 \times 2419 + 0.7 \times 382 \times 456 = 146{,}124$$

so $76{,}448 \leqq F_1 (=100{,}000) \leqq 146{,}124$. Accordingly, during mold closure, the internal pressure did not fall much at all.

The mold could be closed in the state with internal pressure applied.

Next, after closing the mold, the internal pressure P was raised and the pressing force F was changed.

Specifically, the inventors ran tests by the load path of (1)→(2)→(3).

(1) Internal pressure of 10 MPa and axial pressing force of 110,000 N (2) Internal pressure of 20 MPa and axial pressing force of 250,000 N (3) Internal pressure of 80 MPa and axial pressing force of 250,000 N The values of $P \cdot (S_3 - S_1) + 0.5YS \cdot S_1$ and $P \cdot (S_3 - S_1) + 1.5YS \cdot S_1$ in the cases of the above (1) to (3) are calculated by the cases of (1) to (3). Note that the mold sectional area $S_3$ is 1880 mm$^2$.

$$P \cdot (S_3 - S_1) + 0.5YS \cdot S_1 = (1)101{,}336, (2)115{,}576, (3)201{,}016$$

$$P \cdot (S_3 - S_1) + 1.5YS \cdot S_1 = (1), 275{,}528, (2), 289{,}768, (3)375{,}208$$

The above values resulted. In all of (1), (2), and (3), the results are in the preferable range of the pressing force. Accordingly, when working the tube after mold closure by the load path explained above, the part could be formed without seal leakage.

As a result of the above hydroforming, it was possible to obtain a hydroformed product formed with a flange along its entire length.

Example 2

FIG. 8 shows a lower mold 17 for forming a flange in the case of a bent shape. Note that the cross-sectional shape of the groove of the mold cavity is the same as in FIG. 5 and has a flange part at the two sides along the entire length. The radius of curvature is $2.07 \times 10^{-1}$ (=1/484) (1/mm) along the entire length in the longitudinal direction. For the tube material, a STKM13B steel tube of an outside diameter of 60.5 mm, a wall thickness of 2.5 mm, and a total length of 370 mm the same as Example 1 was used.

First, the center of the tube material was bent by ram bending to a radius of curvature of 484 mm (=8 times the outside diameter of the tube material). This bent tube was placed to the groove of the lower mold 17 of FIG. 8. The distance between the mold ends in the middle of the groove was 360 mm, so if placing a 370 mm length tube material, it will stick out from the mold ends by 5 mm each. Accordingly, a seal length $L_S$ of Example 2 of 2 times the plate thickness of 2.5 mm could be secured.

After that, a seal punch of the same shape as Example 1 was used to apply a pressing force while applying internal pressure. The conditions of the internal pressure and pressing force were set the same as in Example 1. In that state, the upper mold (not shown) was made to descend to close the mold. Note that the cross-sectional shape of the upper mold was the same shape as the cross-section of the upper mold shown in FIG. 7. The pressure boosting conditions after mold'closure and the pressure force at that time were made the same conditions as in Example 1.

By the above step, it was possible to obtain a hydroformed product with a flange along its entire length even in the case of a bent shape.

INDUSTRIAL APPLICABILITY

As explained above, according to the present invention, the range of application of hydroformed products is broadened, so parts can be combined and the weight can be reduced. In particular, application to auto parts results in greater reduction of vehicle weight and therefore improved fuel economy and as a result can contribute to suppression of global warming. Further, application to industrial fields where no progress had been made in application up to now, for example, consumer electric products, furniture, construction machinery parts, motorcycle parts, and building parts can be expected.

The invention claimed is:

1. A hydroforming method comprising:

placing a metal tube having tube ends in a lower mold of a mold comprising the lower mold and an upper mold in a manner such that the tube ends stick out from the lower mold, injecting pressurized fluid into the metal tube through an inside of a seal punch while pressing seal punches against the tube ends to apply a predetermined pressing force, filling the inside of said metal tube with a pressurized fluid to apply a predetermined internal pressure, then, while applying said internal pressure and pressing force, lowering the upper mold to close the mold, deforming the tube along with the tube ends and finishing a forming operation with said tube ends sticking out from the mold, wherein said method is characterized in that when a sectional area of a metal part of said metal tube in a cross-section vertical to an axial direction of said metal tube is $S_1$ [mm$^2$], a sectional area of an inside of said metal tube is $S_2$ [mm$^2$], a yield stress of said metal tube is YS [MPa], and said predetermined internal pressure is $P_1$ [MPa], a force $F_1$ [N] pressed by said seal punches when closing the mold satisfies formula (1):

$$P_1 \cdot S_2 + 0.3YS \cdot S_1 \leqq F_1 \leqq P_1 \cdot S_2 + 0.7YS \cdot S_1 \quad (1).$$

2. The hydroforming method as set forth in claim 1, characterized by, after closing the mold, further boosting the internal pressure in said metal tube and ending the forming operation.

3. The hydroforming method as set forth in claim 2, characterized in that when a sectional area of a metal part of said metal tube in a cross-section vertical to an axial direction of said metal tube is $S_1$ [mm$^2$], a sectional area of a cavity of said mold is $S_3$ [mm$^2$], a yield stress of said metal tube is YS

[MPa], and an internal pressure boosted to after closing the mold is P [MPa], a force F [N] pressed by said seal punches when boosting the internal pressure after closing the mold satisfies formula (2):

$$P\cdot(S_3-S_1)+0.5YS\cdot S_1 \leqq F \leqq P\cdot(S_3-S_1)+1.5YS\cdot S_1 \quad (2).$$

4. The hydroforming method as set forth in claim 2, 1 or 3, characterized in that when a length by which the tube ends of said metal tube stick out from said mold before said seal punches press against the tube ends is made the seal length, said seal length is 2 to 4 times a plate thickness of said metal tube.

5. The hydroforming method as set forth in claim 2, 1 or 3, characterized in that a Rockwell hardness of a surface of said seal punches contacting said tube ends is HRC50 or more and a surface roughness is Ra 2.0 or less.

* * * * *

UNITED STATES PATENT AND TRADEMARK OFFICE

CERTIFICATE OF CORRECTION

PATENT NO. : 8,297,096 B2
APPLICATION NO. : 12/452676
DATED : October 30, 2012
INVENTOR(S) : Masaaki Mizumura et al.

It is certified that error appears in the above-identified patent and that said Letters Patent is hereby corrected as shown below:

In the Specifications:

Column 2, line 66, change "an yield stress" to -- a yield stress --;

Column 3, line 47, change "so_as" to -- so as --;

Column 5, line 57, change "$S_3^-S_1$" to -- $S_3$ - $S_1$ --;

Column 7, line 63, change "$2.07 \times 10^{-1}$" to -- $2.07 \times 10^{-3}$ --.

Signed and Sealed this
Sixth Day of May, 2014

Michelle K. Lee

Michelle K. Lee
*Deputy Director of the United States Patent and Trademark Office*